US005647543A

United States Patent [19]

Ma

[11] Patent Number: 5,647,543

[45] Date of Patent: Jul. 15, 1997

[54] ELECTROSTATIC IONIZING SYSTEM

[75] Inventor: Yamin Ma, Roseville, Minn.

[73] Assignee: Graco Inc, Minneapolis, Minn.

[21] Appl. No.: 380,970

[22] Filed: Jan. 31, 1995

[51] Int. Cl.[6] ..... B05B 5/025

[52] U.S. Cl. ..... 239/706

[58] Field of Search ..... 239/706–708, 239/690, 3

[56] References Cited

U.S. PATENT DOCUMENTS

| | | | |
|---|---|---|---|
| 3,589,607 | 6/1971 | Wolf et al. . | |
| 4,009,829 | 3/1977 | Sickles . | |
| 4,120,017 | 10/1978 | Sickles . | |
| 4,157,162 | 6/1979 | Benedek et al. . | |
| 4,186,886 | 2/1980 | Sickles . | |
| 4,240,585 | 12/1980 | Sickles . | |
| 4,258,655 | 3/1981 | Bagby et al. . | |
| 4,266,721 | 5/1981 | Sickles . | |
| 4,275,846 | 6/1981 | Coffee | 239/690 |
| 4,343,433 | 8/1982 | Sickles . | |
| 4,347,984 | 9/1982 | Sickles . | |
| 4,440,349 | 4/1984 | Sickles et al. . | |
| 4,659,012 | 4/1987 | Coffee | 239/690 X |
| 5,044,564 | 9/1991 | Sickles . | |
| 5,297,738 | 3/1994 | Lehr | 239/708 |

FOREIGN PATENT DOCUMENTS

| | | | |
|---|---|---|---|
| 584059 | 9/1959 | Canada . | |
| 887025 | 7/1953 | Germany | 239/707 |
| 1406358 | 9/1975 | United Kingdom | 239/707 |
| 2022464 | 12/1979 | United Kingdom | 239/706 |

*Primary Examiner*—Kevin Weldon
*Attorney, Agent, or Firm*—Douglas B. Farrow

[57] ABSTRACT

An improved electrostatic ionizing system for use in connection with a spray gun, having a conductive needle positioned near the center of the spray gun spray pattern, the needle having a diameter of less than about 250 micrometers and a needle tip sharpened to have a radius of curvature of less than about 50 micrometers, and a second electrode spaced approximately one centimeter from the needle.

20 Claims, 4 Drawing Sheets

ELECTROSTATIC IONIZING SYSTEM

BACKGROUND OF THE INVENTION

The present invention relates to an electrostatic charging system for atomizers and coating applicators; more particularly, the invention relates to an ionizing system adapted for use in connection with an electrostatic paint applicator. The electrostatic paint applicator may be either a hand-held spray gun or may be an automatic spray gun which is operable by remote control connections, or a paint powder applicator. The invention is primarily useful for applying non-conductive liquids and powders, although the principles of the invention also find use in connection with spraying conductive liquids.

In the field of electrostatic spraying, it is desirable to create an electrostatic field in the vicinity between the spray gun and the target or article to be sprayed. The sprayed particles are propagated through this field, and the respective particles pick up voltage charges as they pass through the field. The charged particles are thereby attracted to the article to be sprayed, which is typically maintained at a ground or zero voltage potential so as to create an attractive force between the grounded article and the charged particles. By this process, it is possible to direct a much higher percentage of sprayed particles to the actual article to be sprayed, and thereby the efficiency of spraying is vastly improved over conventional methods.

In a typical electrostatic spraying system, an ionizing electrode is placed in the vicinity of the spray gun spray orifice, the article to be painted is held at ground potential, and an electrostatic field is developed between the ionizing electrode and the article. The distance between the two electrodes may be on the order of about one foot; therefore, the voltage applied to the spray gun electrode must necessarily be quite high in order to develop an electrostatic field of sufficient intensity to create a large number of ion/particle interactions so as to develop a sufficient attractive force between the paint particles and the target. It is not unusual to apply electrostatic voltages on the order of 60,000–100,000 volts (60–100 kv) to the spray gun electrode in order to achieve a proper degree of efficiency in the spraying operation. An ionizing current on the order of 50 microamps typically flows between the grounded article and the spray gun electrode.

Electrostatic systems of the foregoing type are frequently referred to as corona charging systems, because the field intensity creates a corona current from the electrode which ionizes the air in the vicinity, and the atomized paint particles which pass through the region of ionized air pick up the ionized charges and become more readily attracted to a grounded or neutral article to be coated. The efficiency of this process can be determined by the number of ions n which are applied to a typical particle as it passes between the spray gun and the target, according to the relationship $$n=k*E*t*I;$$

where:

n=number of ion charges per droplet;

k=constant

E=electrical field strength in the charging zone;

t=time the droplet is in the charging zone;

I=ion concentration in the charging zone.

The electrical field strength in the charging zone must be sufficiently intensive as to ionize the air in the vicinity of the electrode (in the charging zone) in order to create the corona current described above.

Electrostatic voltage charging systems can be utilized in connection with spray guns whether the primary atomizing forces are created by pressurized air, hydraulic forces, or centrifugal forces. In each case, it is preferable that the ionizing electrode be placed at or proximate to the point where atomization occurs so as to cause the greatest number of atomized particles to pass through the ionizing field. Electrostatic ionizing systems can also be used with conductive or nonconductive paint; but in the case of conductive paint, the placement of the electrostatic ionizing electrode may have to be more carefully positioned so as to avoid developing a conductive path through the liquid paint column prior to the point of atomization. In the prior art, the electrostatic electrode configuration most often used for satisfactory performance is a needle configuration, which permits a high intensity field to develop at the needle tip, wherein the needle is positioned at or proximate to the zone of atomization. In the prior art, these needles are typically made from hardened steel material, frequently stainless steel, typically having a diameter of about 0.5 millimeters (mm) and projecting forwardly from the nozzle a distance of about 2–6 mm. These needles are typically formed from wire material which is cut to length, and no attempt is made to provide a sharpened point on the needle. In some cases the needle end is rounded. The voltage as applied to such needles is usually in the range of 40–100 kv, which develops a relatively high intensity electrostatic field in the vicinity of the needle, wherein the electrostatic field lines are formed between the needle and usually a grounded article to be painted. The field gradient in volts per centimeter (v/cm) is determined by dividing the voltage applied to the needle by the distance in centimeters to the second electrode, usually the article, where the field is developed.

It would be a distinct advantage in the field of electrostatic spraying to provide a construction having a very high electrostatic field intensity with a considerably lower applied voltage than as used in the prior art. For example, reducing the applied voltage from 60 kv to 15 kv greatly simplifies the technical design of the voltage-producing circuitry, reduces the complexity of shielding the electrostatic field from adverse outside influences, and increases the overall safety in operating the system. The factors that can influence the design of an appropriate electrostatic system include the distance between the respective electrodes, the geometry of the electrodes, the position of the electrodes relative to the atomized spray, and the type of material sprayed by the system.

SUMMARY OF THE INVENTION

The invention provides a construction which achieves a satisfactory field intensity E for electrostatic spraying by controlling the geometry of the needle and by controlling the placement of the needle electrode relative to the second electrode. The needle diameter is selected to be less than about 250 micrometers (um), the needle tip is sharpened to have a tip radius of curvature less than about 50 micrometers (um), and the electrode spacing is preferably set to approximately about 1.5 centimeter (cm). The needle is positioned to be relatively near the center of the atomization zone for the particular spray gun to which it is applied. The electrostatic system will develop an ionizing current in the range of 20–50 microamp (ua) with about an applied voltage of 15 kv.

It is the principal object and advantage of the present invention to provide an electrostatic system for spray guns, which provides an electrostatic ionizing field with considerably lower applied voltage than is known in the prior art.

It is a further object and advantage of the present invention to provide an electrostatic system wherein a high intensity field is developed over a relatively short distance and in the atomization zone of the spray gun.

It is a further object and advantage of the present invention to provide a controlled high intensity electrostatic field with a needle electrode having a diameter of less than about 250 micrometers (mm) and having a sharpened needle tip.

BRIEF DESCRIPTION OF THE DRAWINGS

The foregoing and other objects and advantages will become apparent from the following specification and claims and with reference to the appended drawings.

DESCRIPTION OF THE PREFERRED EMBODIMENT

Figure 1:
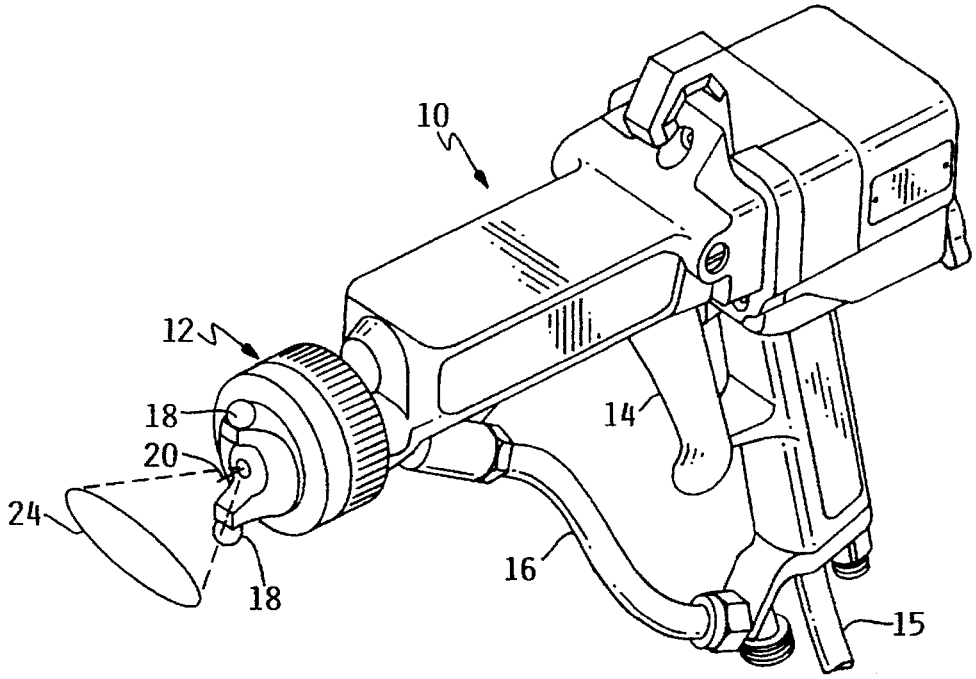
FIG. 1 shows an isometric view of an electrostatic spray gun having a preferred embodiment of the invention.

FIG. 1 shows an isometric view of a typical electrostatic spray gun in conjunction with the present invention. An electrostatic spray gun 10 has a manually-operable trigger 14 for spraying liquid delivered through delivery tube 16 through a spray nozzle 12. The electrostatic high voltage is either developed internally by a high voltage supply in the spray gun, or delivered to spray gun 10 via a cable 15 which ultimately places a high voltage on needle 20 in nozzle 12. A pair of grounded spherical electrodes 18 are affixed to nozzle 12, and a high intensity electrostatic voltage field is developed between needle 20 and spherical electrodes 18. The diameter of each spherical electrode 18 should be at least about ten times the diameter of the needle 20. The atomized spray is ejected from an orifice at the front of nozzle 12 and is shaped into a spray pattern 24. The particles forming the spray pattern 24 are respectively ionized by the electrostatic field through which they pass as they are emitted from the orifice in the spray nozzle 12.

Figure 2:
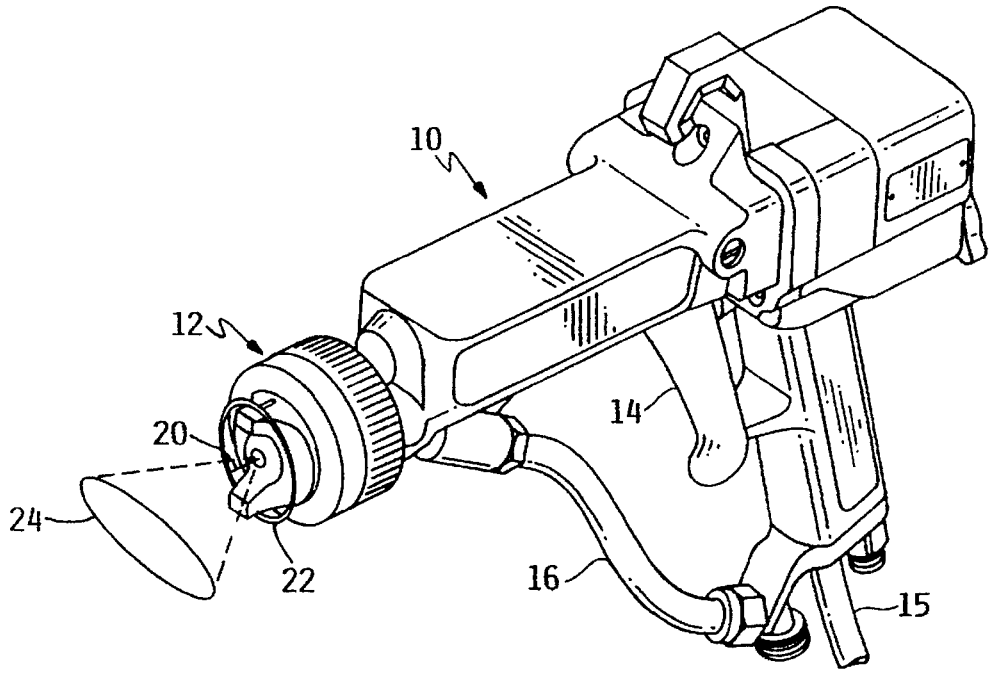
FIG. 2 shows an isometric view of an electrostatic spray gun having a second preferred embodiment of the invention.

FIG. 2 shows an alternative embodiment of the electrostatic ionizing system affixed to spray gun 12. In this example, a grounded ring electrode 22 is affixed to nozzle 12 and surrounds the atomizing orifice in nozzle 12. The needle 20 develops a high intensity electrostatic field to the ring electrode, and the atomized spray particles which form spray pattern 24 pass through the ionizing field as they are propagated forwardly from the spray gun 10.

Figure 3:
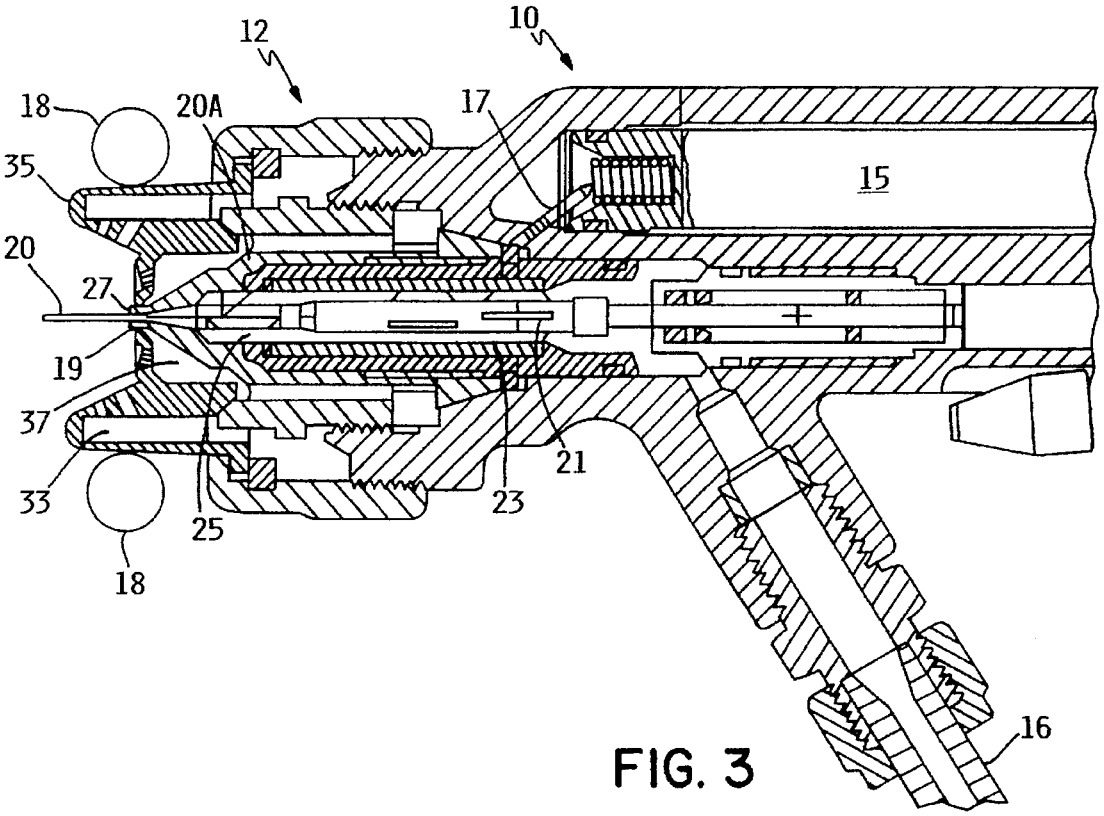
FIG. 3 shows a partial cross-section view of the spray gun of FIG. 1.

FIG. 3 shows a partial cross-section view of the spray gun illustrated in FIG. 1. The needle 20 projects forwardly from a liquid valve 19 which is interposed into the liquid flow path of the spray gun. Needle 20 has a slidable electrical contact 20A which is movable within a tubular resistor 23. Tubular resistor 23 is electrically connected via a conductor 17 to a high voltage coupler 15. High voltage coupler 15 is connected to a high voltage source. Therefore, the high voltage is conveyed to needle 20 via the high voltage coupler 15, conductor 17, tubular resistor 23, and slidable tab 20A. The liquid flow path through spray gun 10 proceeds from liquid delivery tube 16 into the nozzle chamber 25 and through the spray orifice 27. Pressurized air is delivered through passages to air cap chamber 37, and outwardly to impinge upon the liquid emanating from orifice 27 to cause the liquid to become atomized. Further pressurized air is delivered through passages 33 in air cap 35 to impinge upon the atomized particles, and thereby tends to "flatten" or shape the atomized particles into a narrowed spray pattern. The high voltage electrostatic field developed at the point of needle 20 is developed between needle 20 and the grounded spherical electrodes 18. Therefore, a very high intensity electrostatic field is found in the vicinity of the sharpened point of needle 20 to ionize the liquid particles which generally pass about needle 20 in a forward path.

Figure 4:
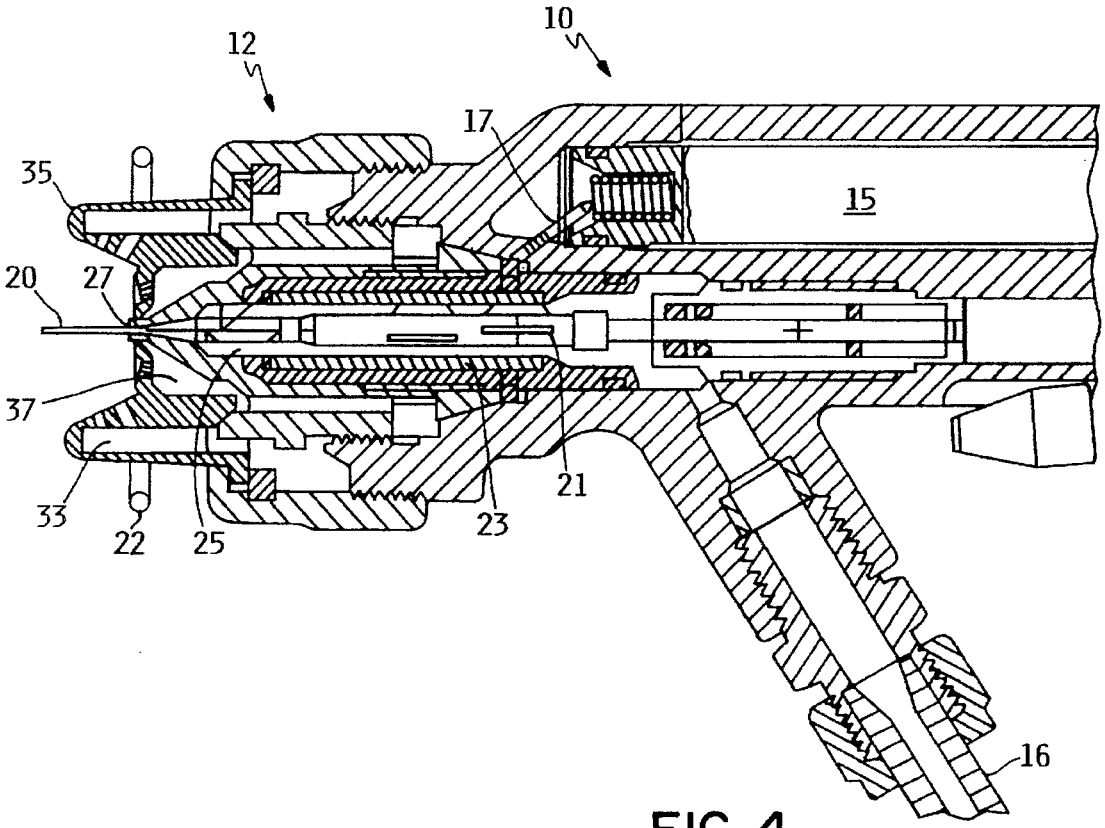
FIG. 4 shows a partial cross-section view of the spray gun of FIG. 2.

FIG. 4 shows a partial cross-section view of the spray gun of FIG. 2, wherein like components have been numbered identically to the components shown in FIG. 3. In all respects, spray gun 10 of FIG. 4 operates identically to spray gun 10 of FIG. 3, the only difference being the arrangement of the electrostatic ionizing system of FIG. 4 versus FIG. 3. In FIG. 4, electrostatic needle 20 develops a high intensity field with the grounded ring electrode 22. This electrostatic field is uniformly dispersed about the axis of the atomized particles emanating from orifice 27, thereby insuring that the atomized particles become fully ionized as they are propagated past needle 20. The ring electrode 22 shown in FIG. 4 is electrically connected to ground potential, as are the spherical conductors 18 shown in FIG. 3, according to techniques which are well known in the art.

An important realization of the present invention is the discovery of the improved ionizing system which can produce a highly efficient coating process without the need for electrostatic voltage potentials in the range of 40–100 kv as was heretofore believed necessary. This results from a construction which places the voltage electrode within less than about one inch from the grounded electrode, together with constructing the voltage electrode to have an extremely sharp ionizing tip or edge. This evolves from the recognition that the requisite ionizing field intensity is inversely proportional to the square root of the radius of curvature of the electrode from which the field emanates; i.e., with the same voltage potential applied between the needle and ground, a sharp tip can create a much higher local field intensity around the tip than can a more rounded configuration. A higher intensity field causes higher electron emissions from the tip, which in turn generates an increased number of ions via a stronger corona current, to increase the charge accumulation on paint droplets passing through the ionization zone. The relatively close spacing of the voltage electrode and the grounded electrode creates a very highly intense ionizing zone, and if this ionizing zone is positioned in or close to the zone of atomization the number of droplets which accumulate higher charges is also increased. The close spacing of the two electrodes does reduce the size of the ionizing zone, and therefore the time that a typical droplet is in the ionizing zone, but this disadvantage is apparently more than offset by the increased ionization density in the ionizing zone. The net result, with about 15 kv applied to the needle electrode of the present invention, produces a droplet charge accumulation equivalent to about 100 kv applied to a conventional electrostatic system.

The corona current produced by the improved ionizing system can range from 50–100 microamperes (50–100 ua), and can produce a heating effect at the point of emanation from the sharpened tip or edge. Therefore, it is important that a material having a relatively high melting point be selected for the needle construction.

Figure 5:
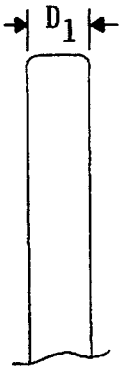
(PRIOR ART) FIG. 5
FIG. 5 shows a partial elevation view of a prior art electrostatic needle.

FIG. 5 shows an enlarged partial elevation view of a typical needle as known in the prior art. Such a needle is typically formed of a hardened steel such as stainless steel, and the diameter $D_1$ is usually about 0.5 millimeters.

Figure 6:
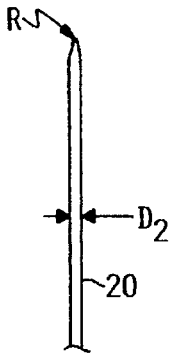
FIG. 6 shows a partial elevation view of the electrostatic needle of the present invention.

FIG. 6 shows an enlarged partial elevation view of the needle of the present invention which is preferably formed of an alloy having a high melting point, preferably above 2,300° Celsius (°C.). A preferred material for forming needle 20 is tungsten, which has a melting point of 3,410° C. Needle 20 has a diameter of $D_2$, which is preferably less than about 250 micrometers (um). Needle 20 is sharpened to a point having a radius of curvature "R." Radius "R" is less than 50 um and is preferably less than 25 um.

Figure 7:
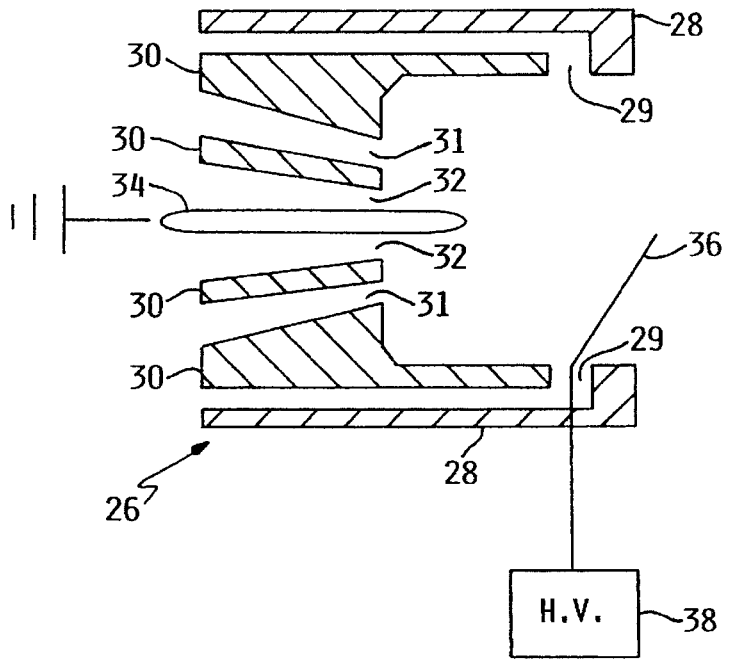
FIG. 7 shows a diagrammatic view of one form of placement of the needle of the present invention.
Figure 8:
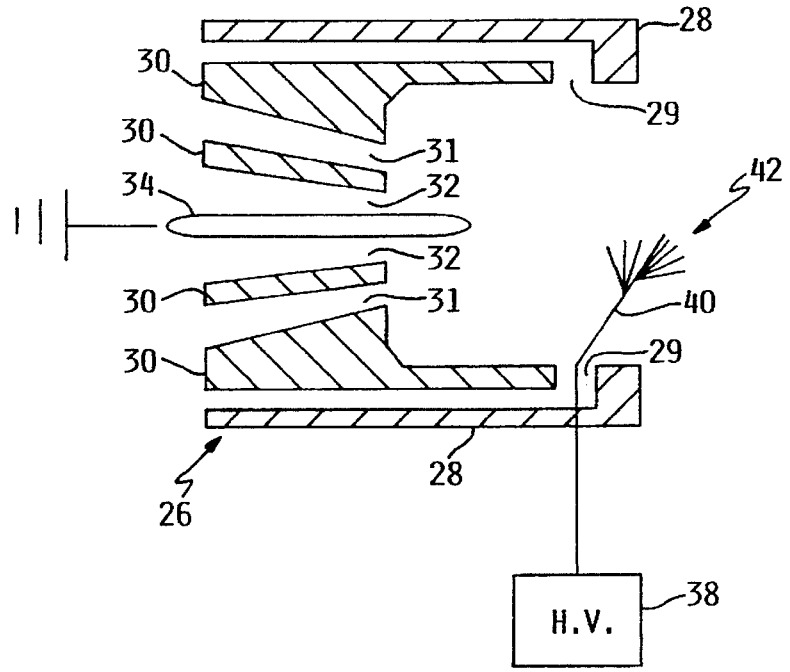
FIG. 8 shows a diagram of a second form of the present invention.

FIG. 7 shows a cross-section diagrammatic view of an alternative embodiment of the invention. In the embodiment shown in FIG. 7, the components are generally cylindrical in shape with a view taken along a diameter of the cylindrical array of components. An air cap 28 forms an outer cylindrical member enclosing a fluid nozzle 30. A pair of air passages 29 pass between fluid nozzle 30 and air cap 28. Fluid nozzle 30 has an annular air passage 31 surrounding a correspondingly annular liquid passage 32. Centered in liquid passage 32 is a grounded rod 34. A needle 36 is connected to a high voltage supply 38, the needle 36 having a sharpened point in the zone of atomization of liquid particles which emanate from liquid passage 32. The liquid passing through passage 32 becomes atomized under the influence of pressurized air through passage 31. The atomized particles are "flattened" by air from passages 29 to form a shaped, atomized spray pattern in the vicinity proximate the point of needle 36. FIG. 8 shows the same overall embodiment with a different form of high voltage electrode. In this case, a needle conductor 40 is connected to a high voltage supply 38; but the ends of needle conductor 40 are formed into a plurality of brush needle points 42. The brush needle points 42 are each extremely fine wires having individual sharpened points with radii of about 15 um, wherein the points of the brush needle 42 are proximate the zone of atomization for particles emanating from the spray nozzle 26.

Figure 9:
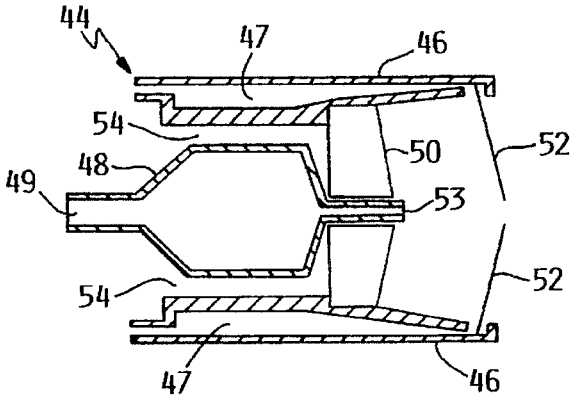
FIG. 9 shows a diagram of a third form of the invention.

FIG. 9 shows a further alternate embodiment of a spray nozzle 44 which utilizes the electrostatic ionizing system described herein. An air cap 46 surrounds a fluid nozzle 48 which has an orifice 53 projecting through the center of a grounded air cap face 50. Air cap face 50 is metallic and is electrically connected to ground (not shown). Air cap 46 has two air passages 47 which confine pressurized air for shaping the atomized pattern. Further air passages 54 surround the fluid nozzle 48 and emit pressurized atomizing air between the outer surface of fluid nozzle 48 and the air cap face 50, thereby to atomize liquid particles emanating from orifice 53. The liquid particles are admitted into fluid nozzle 48 via a liquid passage 49. A pair of electrostatic needles 52 are projecting from air cap 46 and are connected to a source of high voltage power (not shown). Needle electrodes 52 are of the type generally described in connection with this invention having a very narrow diameter and a sharpened point, the respective points of the needle electrodes 52 being positioned in the zone of atomization of nozzle 44.

Figure 10:
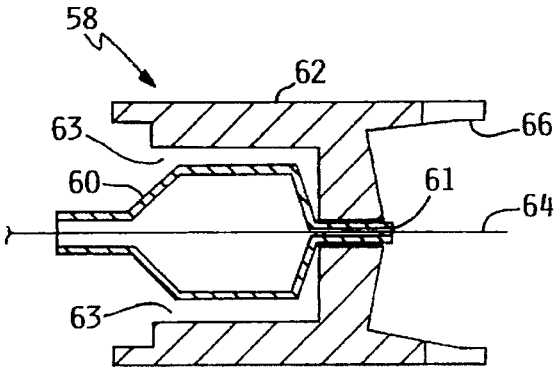
FIG. 10 shows a diagram of a fourth form of the invention.

FIG. 10 shows a further embodiment of a spray nozzle 58 utilizing the principles of the present invention. In this case, an air cap 62 surrounds a fluid nozzle 60; and air passages 63 are formed therebetween. The liquid passing through fluid nozzle 60 is emitted via orifice 61, and the pressurized air passing through air passages 63 are emitted through the annular orifice surrounding fluid nozzle 60, in the region between air cap 62 and fluid nozzle 60. A needle electrode 64 is inserted through the center of fluid nozzle 60 and is connected to an electric ground connection. A metal ring 66, which can be part of the spray nozzle air cap, is formed on the forward periphery of air cap 62, and metal ring 66 is connected to a source of high voltage (not shown). In this example, the needle electrode 64 is of the type generally described in connection with this invention; and the forward point of needle 64 is placed into the atomization zone for the liquid particles emanating from the nozzle 58. The ionizing field is developed between the point of needle electrode 64 and the circumferential ring 66, thereby creating a uniform ionizing field through which all of the atomized particles will pass.

In operation, the high voltage supply to the electrostatic needle of the spray gun shown in the various embodiments is approximately 15 kv. This voltage will create a stable corona current at least in the range of 20–50 microamps (ua) wherein the entire corona current flows from the extremely sharpened tip of the electrostatic needle. This relatively high corona current put together with the sharpened needle point tends to create heat in the vicinity of the needle point; and therefore, it is important that the needle be made from a material which has a high melting point in order to maintain the sharpness of the needle point when heated. The preferred material for use in connection with this invention is tungsten, although carbon, osmium and rhenium also have melting points in excess of 3,000° C. Other materials with high melting points which might be suitable for use in connection with the invention include boron, molybdenum, niobium, tantalum and ruthenium, but other factors such as cost may limit the choices of material. In operation, the intensely high electrostatic field which emanates from the sharpened point of the needle is distributed to the grounded electrode in such a manner that the electrostatic field is relatively centered in the flow of the atomized particles emanating from the spray gun. Therefore, the high proportion of the atomized particles become ionized and are electrostatically attracted to the article to be painted, which itself is held at ground potential.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention. For example, the principles of the present invention could be achieved with an electrode having a sharpened edge, even though not in the form of a needle, if the teachings herein were applied to its construction.

What is claimed is:

1. In an electrostatic spray gun having an ionizing needle operable in conjunction with a second electrode, with a voltage differential developed therebetween, for providing an electrostatic field and corona discharge for charging particles emitted through the field by the spray gun, the improvement in an ionizing system comprising;

(a) said ionizing needle positioned proximate the pattern of particles emitted from the spray gun, and said ionizing needle having sharpened point with a radius of curvature less than about fifty micrometers (50 um); and (b) said second electrode positioned outside the pattern of particles emitted from the spray gun and within about 1.5 centimeters from said ionizing needle, said second electrode further comprising at least one metal sphere positioned along an axis passing through and transverse to the axis of said needle.

2. The improved system of claim 1, wherein said ionizing needle further comprises a diameter of less than about 250 um.

3. The improved system of claim 1 or 2, wherein said ionizing needle further comprises a metallic member having a melting point above 2,300° C.

4. The improved system of claim 3, wherein said ionizing needle is made from tungsten material.

5. The improved system of claim 1, wherein said second electrode further comprises a metallic ring positioned about the axis of said needle.

6. The improved system of claim 1, wherein said at least one metal sphere has a diameter of at least ten times the diameter of said needle.

7. The improved system of claim 1, wherein said ionizing needle further comprises a diameter of less than about 250 um.

8. The improved system of claim 1, wherein said ionizing needle further comprises a metallic member having a melting point above 2,300° C.

9. The improved system of claim 8, wherein said ionizing needle is made from tungsten material.

10. The improved system of claim 1, wherein said voltage differential further comprises about 15 kilovolts.

11. An electrostatic ionizing system for attachment to a spray gun proximate the atomizing nozzle which emits a pattern of atomized particles, comprising (a) a needle electrode positioned to place a tip of said needle proximate the pattern of atomized particles, said needle having a diameter of less than 250 micrometers and having a sharpened tip with a radius of curvature of less than 50 micrometers;

(b) a second electrode positioned proximate the pattern of atomized particles and within about 1.5 centimeters from said sharpened, tip; whereby said pattern is between said needle electrode and said second electrode wherein said second electrode further comprises at least two metal spheres respectively oppositely positioned along an axis passing through said ionizing needle; and (c) means for applying a voltage potential difference between said needle electrode and said second electrode.

12. The system of claim 11, wherein said ionizing needle is made from a material having a melting point of at least 2,300° C.

13. The system of claim 11 or 12, wherein said second electrode further comprises a metallic ring concentrically positioned about said needle.

14. The system of claim 11 or 12, wherein said second electrode further comprises at least two metal spheres respectively oppositely positioned along an axis passing through said ionizing needle.

15. The system of claim 11 or 12, wherein said voltage potential difference is about 15 kilovolts.

16. In an electrostatic atomizer having an ionizing electrode operable in conjunction with a second electrode, with a voltage differential developed therebetween, for providing an electrostatic field and corona discharge for charging particles emitted through the field by the spray gun, the improvement in an ionizing system comprising:

(a) said ionizing electrode positioned proximate the pattern of particles emitted from the atomizer, and said ionizing electrode having a sharpened edge with a radius of curvature less than about fifty micrometers (50 um); and (b) said second electrode positioned outside the pattern of particles emitted from the atomizer and within about 1.5 centimeters from said ionizing electrode, wherein said second electrode further comprises at least one metal sphere positioned along an axis passing through and transverse to the axis of said ionizing electrode.

17. The improved system of claim 16, wherein said ionizing electrode further comprises a metallic member having a melting point above 2,300° C.

18. The improved system of claim 17, wherein said ionizing electrode is made from tungsten material.

19. The improved system of claim 16, wherein said second electrode further comprises a metallic ring positioned about said ionizing electrode.

20. The improved system of claim 16, wherein said at least one metal sphere has a diameter of at least ten times the radius of curvature of said edge.

* * * * *